United States Patent [19]

Bollinger

[11] Patent Number: 4,993,318

[45] Date of Patent: Feb. 19, 1991

[54] NEWSPAPER BUNDLER

[76] Inventor: William G. Bollinger, 838 N. 10th St., Manitowoc, Wis. 54220

[21] Appl. No.: 352,045

[22] Filed: May 15, 1989

[51] Int. Cl.[5] ..... B65B 13/18

[52] U.S. Cl. ..... 100/34; 100/1; 100/912; 229/117; 229/122

[58] Field of Search ..... 100/1, 34, 912; 229/120.37, 120.38, 122, 117

[56] References Cited

U.S. PATENT DOCUMENTS

| | | | |
|---|---|---|---|
| 1,246,923 | 11/1917 | Horrigan . | |
| 2,477,059 | 7/1949 | Hill . | |
| 2,730,310 | 1/1956 | Schultz . | |
| 2,747,498 | 5/1956 | Bellar | 100/34 |
| 3,017,021 | 1/1962 | Ruiz . | |
| 3,357,344 | 12/1967 | Pate | 100/34 |
| 3,779,152 | 12/1973 | Smith | 100/34 |
| 3,903,789 | 9/1975 | Hurley | 100/34 |
| 4,511,042 | 4/1985 | Wischusen, III | 229/122 X |
| 4,583,678 | 4/1986 | Weimer, Jr. | 229/117 X |

*Primary Examiner*—Harvey C. Hornsby
*Assistant Examiner*—Stephen F. Gerrity
*Attorney, Agent, or Firm*—Lathrop & Clark

[57] ABSTRACT

A newspaper bundler (9) having a container portion (10) formed of a unitary paperboard blank for holding the newspapers (310) to be bundled in regular arrangement, a gripper ring (50) to firmly grasp and retain a ball of string (300), a string magazine portion (11) formed of a second unitary paperboard blank to facilitate dispensing of the string into the container portion prior to the insertion of the newspapers. The bundler has string fasteners (42, 44, 46) which retain the string about the newspapers in advance of final bundling. The bundler may be assembled from the two paperboard blanks, and may be shipped in a compact, partially assembled form.

24 Claims, 6 Drawing Sheets

NEWSPAPER BUNDLER

BACKGROUND OF THE INVENTION

1. Field of the Invention

This invention relates to devices for bundling flat articles in general and for bundling and tying up used newspapers for recycling purposes in particular.

2. Description of the Prior Art

In order to conserve the many natural resources which go into the manufacture of newsprint, many municipalities require that consumers recycle their newspapers. In order to facilitate collection of newsprint for recycling, the papers must be tied and bundled into uniform bales.

The prior art is cognizant of devices for bundling newspapers, bags, and other flat articles. U.S. Pat. No. 1,246,923, for example, teaches a heavy-duty paper bundling press with a holder for a spool of binder cord and mechanisms for receiving and retaining in proper position cord for bundling. However, such devices are usually costly, bulky, somewhat unsightly, or difficult to use, and therefore more suited to high volume users in industry or retail business than consumers.

Newsprint, however, is predominately consumed in any community by a large number of dispersed households at the rate of one to three newspapers per day. Efficient collection of newsprint requires that a large number of cooperating households must be induced or coerced to save and collect their newspapers continuously, on an ongoing basis, and to periodically bundle the newspapers up in neat, tied bundles of prescribed size, for municipal or private pick-up. For household consumers, this means that newspapers must be saved, accumulated, neatly stacked and tied with string or cord in bundles or bales of prescribed size.

Because the profits of recycling in most municipal plans are not directed to the consumer, there is a need for a low cost, light-weight, compactly transported bundler that is very easy to assemble and use, and that will provide unobtrusive and not unattractive storage for used newspapers in the home.

Cardboard boxes have commonly been used in the home to store used newspapers, but these devices tend to be flimsy, unsightly, and contribute little to the reduction of the newspaper bundling task time.

In an effort to overcome these deficiencies, a newspaper bundler has been designed utilizing unitary paperboard blanks, string, and fasteners that is low cost, compact and light weight for efficient storage and transport to and by the consumer, easy to assemble and easy to use by the consumer, and easily decorated or printed to provide a tolerable or even decorative appearance for convenient location in the home to receive and facilitate bundling and tying of used newspapers.

SUMMARY OF THE INVENTION

The present invention is summarized in that a device for bundling newspapers includes first and second paperboard blanks. The first paperboard blank has a side wall including a string end panel, a back panel, two side panels and an attachment panel extending from an edge of one of the panels. The panels are defined in part by fold lines, the first blank being bendable along the fold lines so that the attachment panel may be connected to another panel and the side wall may form a closed rectangle. Bottom panels depend from the side wall panels along a fold line and are adapted to engage together in assembled relation to form a bottom for the closed rectangular side wall. The second paperboard blank has a front panel and a top panel, the panels being defined in part by fold lines and the second blank being foldable along fold lines so that the second blank may be inserted in the assembled first blank adjacent the string end panel with the front panel of the second blank substantially parallel to and spaced from the string end panel and the top panel positioned at an angle to the string end panel and spaced from the bottom of the second blank. The string end panel, top panel, front panel and bottom then define a string compartment for containing a ball of string. The second blank defines a hole for feeding a length of string from the string compartment. The front panel and the three side wall panels other than the string end panel cooperate to define a paper compartment sized to receive folded newspapers in flat, stacked relation. String fastener means are provided for engagement on the side wall panel in spaced relation to the bottom for retaining the length of string around stacked newspapers in the paper compartment to facilitate tying the stacked newspapers in a bundle.

Gripper fingers may be formed in the string end panel to position and retain a ball of string substantially within the string compartment.

It is an object of the invention to provide an improved construction for a newspaper bundler.

It is also an object of the present invention to provide a newspaper bundler with an integral string magazine adapted to dispense string for the tying of recycled newspapers.

It is an additional object of the present invention to provide a newspaper bundler formed of corrugated paperboard and utilizing double thickness walls for structural rigidity.

It is a further object of the present invention to provide a newspaper bundler constructed from unitary paperboard blanks incorporating cut paperboard gripper fingers adapted to grip a large ball of string.

It is a still further object of the present invention to provide a newspaper bundler with string-retaining means to assist in the tying of newspaper bundles.

It is a still further object of the present invention to provide a newspaper bundler that may be shipped and displayed for sale in a compact, stackable, partially assembled form.

These objects, and others, will become apparent from the following detailed description taken in conjunction with the accompanying drawings showing a preferred embodiment of the invention for exemplification.

DESCRIPTION OF PREFERRED EMBODIMENT

Figure 1:
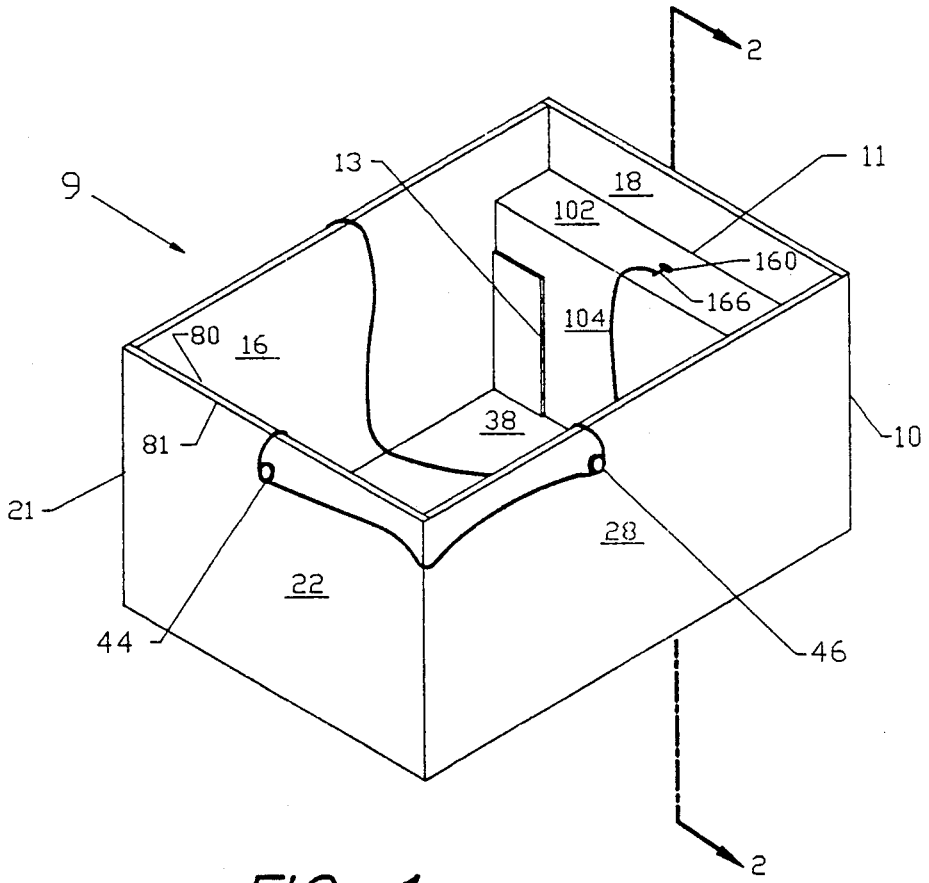
FIG. 1 is a perspective view of one form of the assembled newspaper bundler device of my invention.

Referring more particularly to FIGS. 1-8 wherein like numerals refer to similar parts, the newspaper bundler 9 of the invention includes a container portion 10, a string magazine portion 11, a string gripper portion 17, three string fasteners 42, 44 and 46, and two integral bracing flaps 13 and 14.

Figure 3:
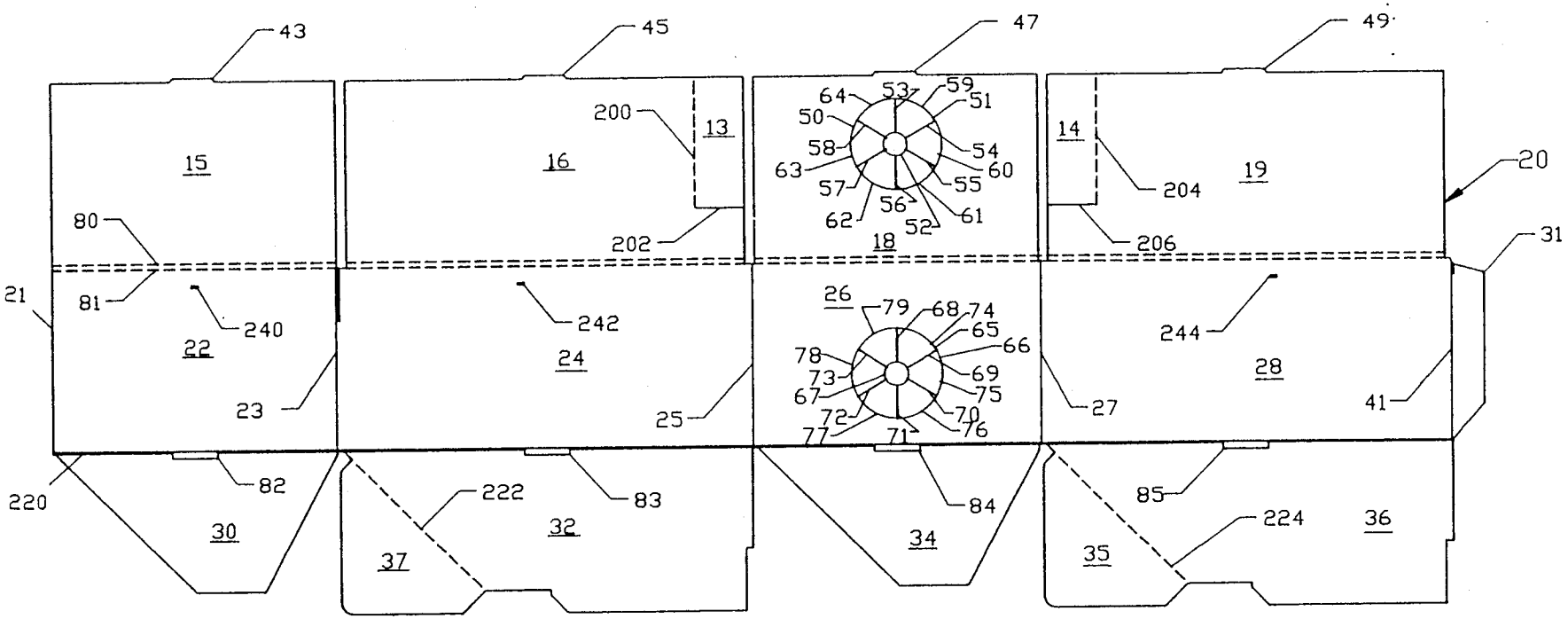
FIG. 3 is a plan view of a unitary paperboard blank for forming the container portion of this invention.
Figure 4:
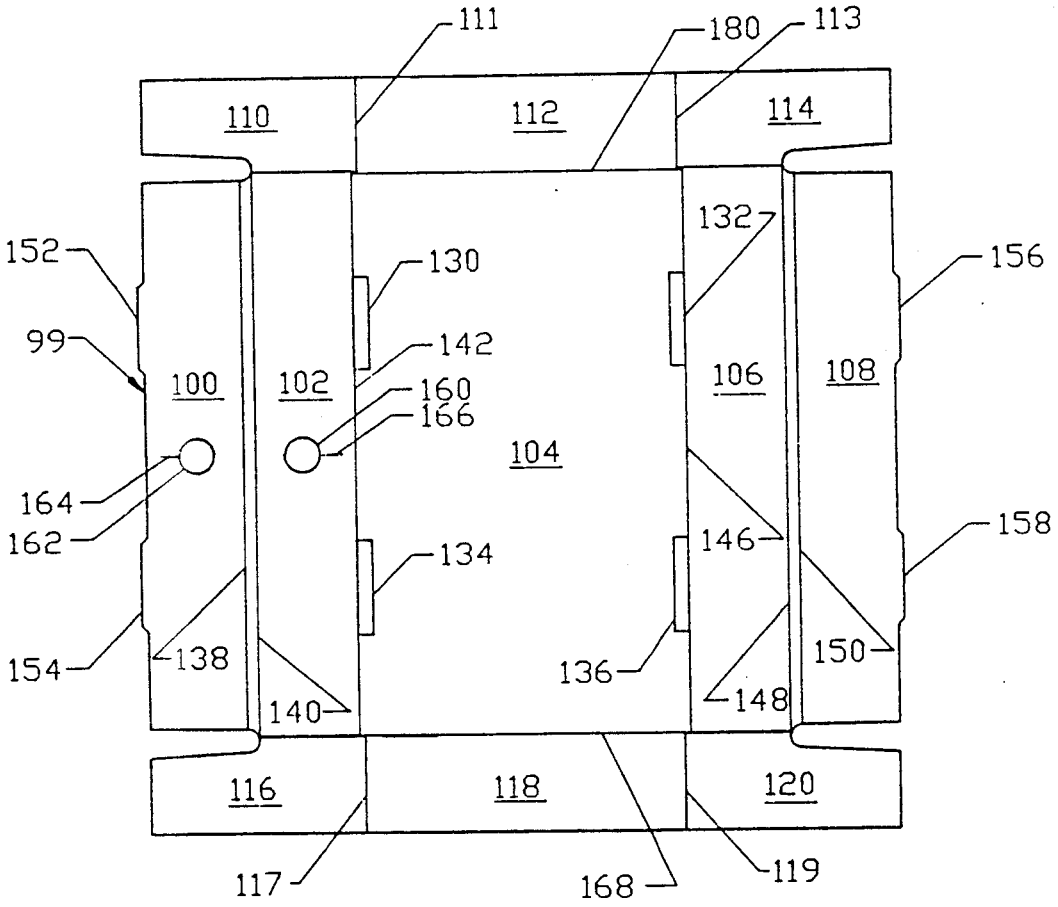
FIG. 4 is a plan view of a unitary paperboard blank for forming the string magazine portion of this invention.

The container portion 10, as shown in FIG. 1, may be preferably constructed from a corrugated paperboard blank 20 which is illustrated in FIG. 3. The string magazine portion 11, which is also shown in FIG. 1, may be preferably constructed from a corrugated paperboard blank 99 as shown in FIG. 4.

Referring now to FIG. 3, there is illustrated a corrugated paperboard blank 20 for the container portion 10. The dashed lines represent score lines, known to the art, as more fully described herein. The paperboard blank 20 includes a side wall 21, which consists of a bare end panel 22, a first side panel 24, a string end panel 26, and a second side panel 28. The panels 22, 24, 26 and 28 are of substantially equal height. The bare end panel 22 and the string end panel 26 are of the same width; the first side panel 24 and the second side panel 28 are of the same width. The bare end panel 22 is separated from the first side panel 24 by the fold line 23, the string end panel 26 is separated from the first side panel 24 by the fold line 25, and the second side panel 28 is separated from the string end panel 26 by the fold line 27. The attachment panel 31 extends outwardly from the second side panel 28 and is separated therefrom by the fold line 41. In its finished state, the attachment panel 31 will be cemented, glued or otherwise attached to the bare end panel 22.

Extending upwardly from the top edge of the side wall 21 are the interior bare end flap 15, the interior side flap 16, the interior string end flap 18, and the interior side flap 19. The interior flaps 15, 16, 18 and 19 are separated from the side wall 21 by fold lines, preferably in the form of score line 80 and the score line 81 adjacent to the top edge of the side wall 21. Extending upwardly from the interior flaps 15, 16, 18 and 19 are the tabs 43, 45, 47 and 49 respectively.

Located on the interior string end flap 18 is the interior gripping ring 50, comprised of the circular fold line 51, the circular cut-out 52, and the cut lines 53-58. Located on the string end panel 26 is the exterior gripping ring 65 comprised of the circular fold line 66, the circular cut-out 67 and the cut-lines 68-73.

The cutlines and the cut-out openings of the gripping rings define the gripping fingers 59-64 and 74-79 which pivotally depend from the circular fold lines and cooperate to engage a large ball of string and retain the ball within the opening.

Extending rightwardly from the first interior side flap 16 is the integral bracing flap 13 which is separated from the flap 16 by a fold line preferably in the form of score line 200 and a cut-line 202. Extending leftwardly from the second interior side flap 19 is the integral bracing flap 14 separated from the interior side flap 19 by a fold line preferably in the form of score line 204 and a cut-line 206.

Depending downwardly from the side wall 21 and separated by the fold line 220 are the bottom flaps 30, 32, 34 and 36. Extending leftwardly from the bottom flap 32 and separated by a diagonal fold line preferably in the form of score line 222 is the glue flap 37. Extending leftwardly from the bottom flap 36 and separated by a diagonal fold line preferably in the form of score line 224 is the glue flap 35. Located on the bottom flaps 30, 32, 34 and 36 adjacent to the fold line 220 are the slots 82, 83, 84 and 85. Located on the upper portions of the bare end panel 22, the side panel 24, and the side panel 28 are the fastener cuts 240, 242 and 244.

Figure 8:
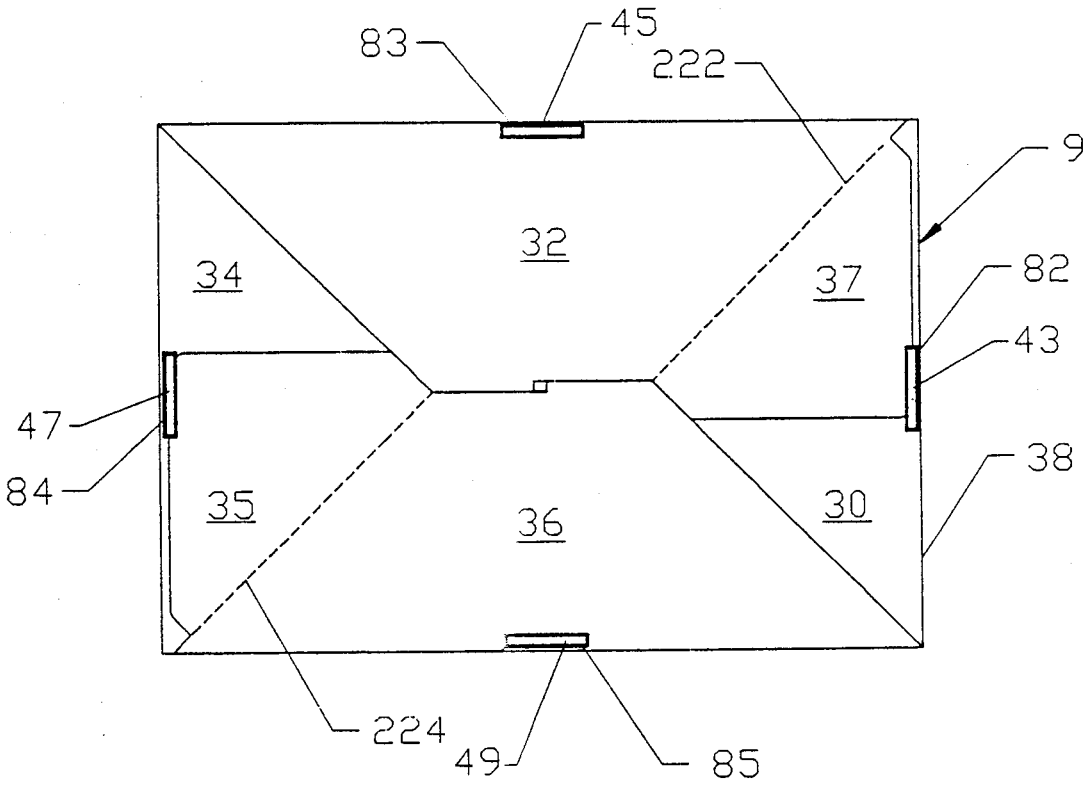
FIG. 8 is a plan view of the bottom of the assembled bundler of FIG. 1.

In assembling the paperboard blank 20, the attachment panel 31 will be glued to the bare end panel 22 to form the four sides of the container portion of the device. The glue flap 37 will be glued onto the surface of the bottom flap 30 and the glue flap 35 will be glued onto the surface of the bottom flap 34 and all four bottom flaps will interlock to form the bottom 38 of the container portion 10 as shown in FIG. 8. The string fasteners 42, 44 and 46 will be inserted into the fastener cuts 242, 240 and 244 respectively. Interior flaps 15, 16, 18 and 19 will then be folded along score lines 80 and 81 so that tabs 43, 45, 47 and 49 will insert into slots 82, 83, 84 and 85 respectively.

Referring now to FIG. 4 there is illustrated an integral paperboard blank 99 for the string magazine portion 11. The paperboard blank 99 includes a front panel 104, which is distinguished on the top by a fold line 142, on the left by a fold line 168, on the bottom by a fold line 146, and on the right by a fold line 180. Extending upwardly from the front panel 104 adjacent to the fold line 142 is the outer top panel 102, which is distinguished on its top by the fold line 140. Extending upwardly from the outer top panel 102 adjacent to the fold line 138 extending parallel to the fold line 140 is the inner top panel 100. The tabs 152 and 154 extend from the inner top panel 100.

Located in the center of the outer top panel 102 is the top string hole 160. Extending from the string hole 160 is the top string braking slit 166. Located on the inner top panel 100 is the interior string hole 162. Extending from the interior string hole 162 is the interior string braking slit 164. Extending downwardly from the front panel 104 adjacent to the fold line 146 is the outer bottom panel 106, which is distinguished by the fold line 148. Extending downwardly from the outer bottom panel 106 adjacent to the fold line 150 is the inner bottom panel 108. Extending downwardly from the inner bottom panel 108 are the tabs 156 and 158. Adjacent to the fold line 142 are the slots 130 and 134. Adjacent to the fold line 146 are the slots 132 and 136. Extending from the front panel 104 adjacent to the fold line 168 is the right panel 118. Extending from the right panel 118 adjacent to the fold line 117 is the right insert 116. Extending from the right panel 118 adjacent to the fold line 119 is right insert 120. Extending from the front panel 104 adjacent to the fold line 180 is the left panel 112. Extending from the left panel 112 adjacent to the fold line 111 is the left insert 110. Extending from the left panel 112 adjacent to fold line 113 is the left insert 114.

In its assembled form, the inner top panel 100 of the blank 99 will be folded along the fold lines 138 and 140 against the outer top panel 102 so as to engage the tabs 152 and 154 in the slots 130 and 134 respectively. Likewise, the inner bottom panel 108 will be folded along the fold lines 150 and 148 against the outer bottom panel 106 so as to engage the tabs 156 and 158 in the slots 132 and 136 respectively. The left panel 112 will be folded along the fold line 180 so that the left insert 110 will be inserted between the inner and outer top panels 100 and 102. Likewise, the left insert 114 will be inserted between the inner and outer bottom panels 106 and 108. The right panel 118 will be folded along the fold line 168 so that the right insert 116 is inserted between the inner and outer top panels 100 and 102 and so that the right insert 120 is inserted between the inner and outer panels 106 and 108. By so doing, the box-like string magazine portion 11 of FIG. 1 is formed.

Use of the newspaper bundler of this invention is illustrated by FIGS. 1, 2, 5 and 6. The gripper portion 17, comprising the gripping rings 50 and 65 functions together with the string magazine 11 to provide unimpeded dispensing of string for the bundling of newspapers. The free end of the ball of string 300 is first threaded through the string holes 160, 162 of the string magazine and the string magazine is pressed up against the interior string end flap 18. The user next presses the ball 300 forcefully against the pre-cut sections of the exterior gripping ring 50. This force causes the gripping fingers 59–64 and 74–79 to deform inwards and to exert a resilient force on the ball of string 300 holding it firmly in the string end panel 26 of the container portion. The string magazine 11 is then held in place by bracing flaps 13 and 14. The string is then pulled tight, fixedly engaging it in string braking cuts 164 and 166 to insure that the string cannot fall back into the string magazine. The front wall of the magazine holds the newspapers to be bundled away from the feeding string and permits repeated bundlings without requiring further attention to the string supply by the user until the entire ball is exhausted.

Figure 5:
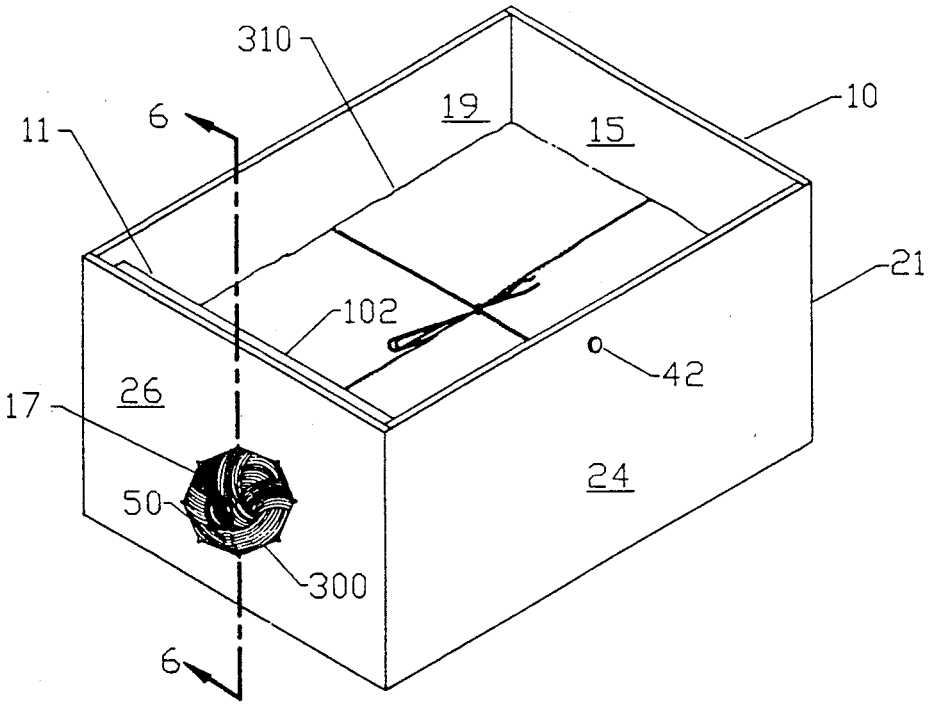
FIG. 5 is a perspective view of the assembled invention showing the gripping rings engaging a large ball of string with papers bundled.
Figure 6:
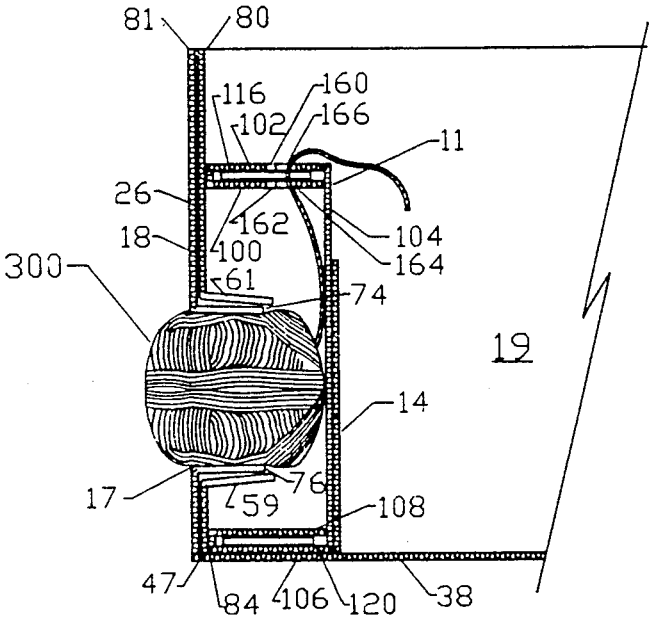
FIG. 6 is a partial section view taken along section line 6—6 of FIG. 5, with newspapers omitted showing string gripper fingers in the string end panel retaining a large ball of string substantially within the string compartment.

After the string is threaded through the string holes 160 and 162 the string is drawn out and laid longitudinally along the bottom 38, of the container portion 10, then up the interior flap 15 which has been folded upon the bare end panel 22, and wrapped around fastener 44. Then the string may be extended around the outside end corner of the container portion 10 formed by the end panel 22 and the side panel 28. The string may then be wrapped around fastener 46. Finally the string may be extended down the interior side flap 19, laid transversely across the bottom 38, up the interior side flap 16 and wrapped around fastener 42 inserted in the side panel 24. FIG. 1 shows the invention fully strung and ready for paper. Newspapers 310 are then inserted into the container portion 10 over the extended string. When the container portion 10 is filled to the desired height with newspapers 310, the string is cut at the string brake 166 and tied around the bundle as shown in FIG. 5.

Figure 2:
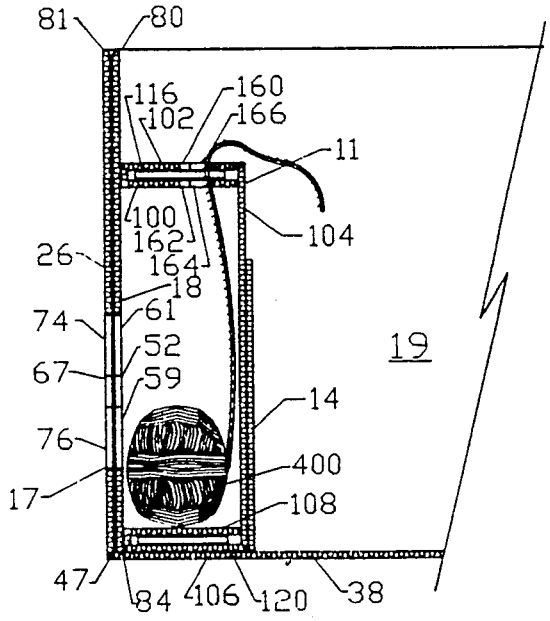
FIG. 2 is a partial section view of the invention taken along section line 2—2 of FIG. 1, showing the string magazine loaded with small ball of string.

Referring now to FIG. 2, it is seen how the paper bundler of this invention may be used with a small ball of string 400 contained entirely within the string magazine 11. The magazine is held firmly in position against dislodging tension on the pulled string by the integral bracing flaps 13 and 14 extending from interior flaps 16 and 19. The string from the small ball of string 400 is threaded through the string holes 162 and 160 and allowed to enter the container portion 10 of the device. The string feeding from the interior of the ball 400 is able to be extended into the device unimpeded as the ball is held snugly by the front panel 104 of the magazine portion.

Figure 7:
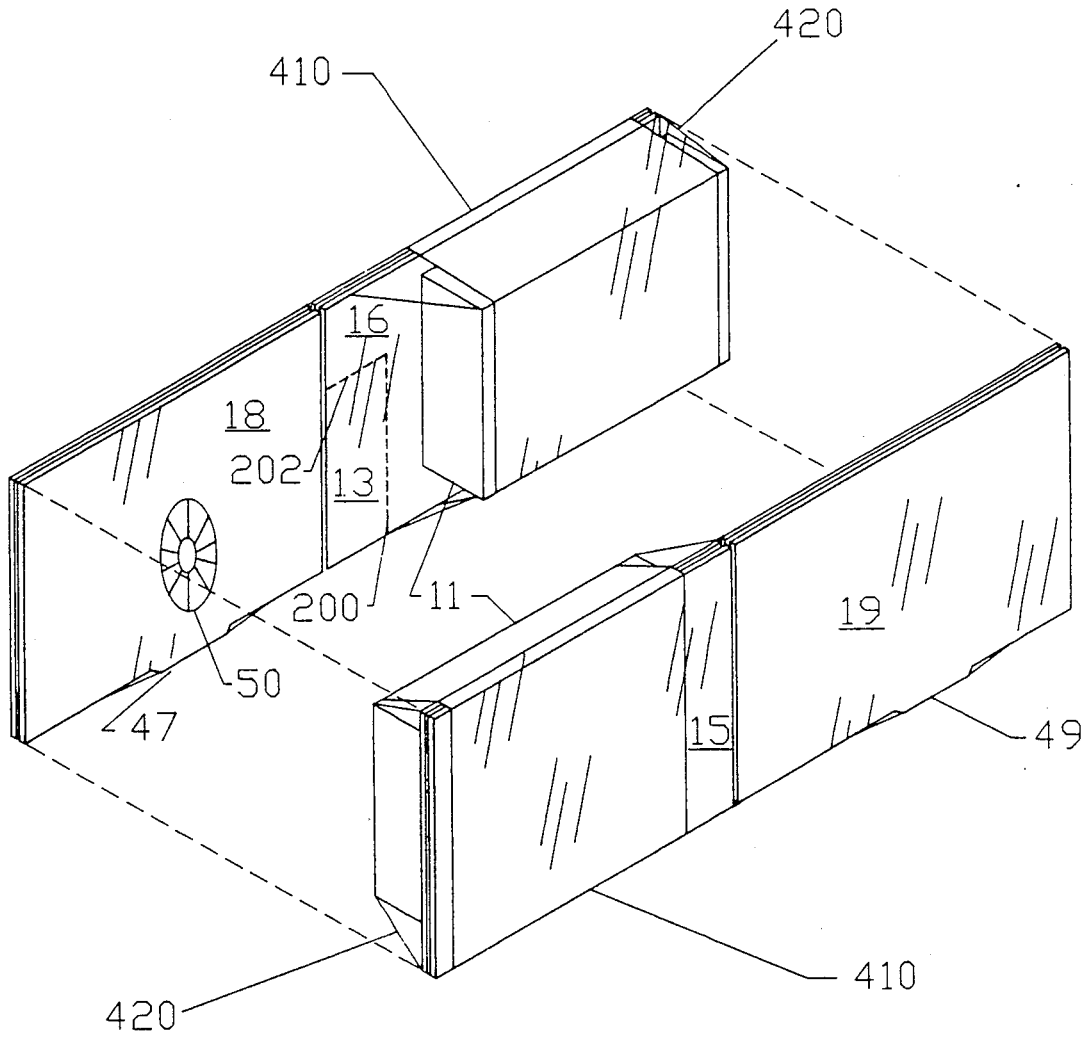
FIG. 7 is a perspective view of two partially assembled devices disposed for shipping.

Referring now to FIG. 7 it is seen how the paper bundler of this invention may be partially assembled and packaged for convenient shipping and display. The corrugated paperboard blank 20 of the container portion 10 is folded about fold lines 23 and 27 to bring panels 24 and 26 parallel to panels 22 and 28. Glue flap 37 will be glued to bottom panel 30 and glue flap 35 will be glued to bottom panel 34 and the bottom panel assemblies thus formed will be folded along score lines 222 and 224 to bring bottom panels 30, 32, 34 and 36 within the two halves of the folded side wall. The interior flaps 15, 16, 18 and 19 will be folded about the score lines 80 and 81 to lie flat on top of the side panels 22, 24, 26 and 28 respectively, to form a compact, flat partial assembly. Three string fasteners 42, 44 and 46 are placed inside a small ball of string 400 which may be contained within the margins of the assembled string magazine portion 11. The ball is then held in place over the folded side wall 21 of the container portion 10 by the string magazine portion 11. The string magazine portion, in turn, may be held in place by a paper wrapper 410. Optionally, the entire package may be shrink-wrapped or otherwise covered by a plastic wrapper 420. The stepped shape of the resultant package permits compact shipment of a number of devices with the packages being alternately oriented with the string magazine portions of each two alternate packages adjacent to each other, as shown.

Variations in the size and location of cut and fold lines could be made to produce a different carton which would still embody the properties of this invention. Instead of being held in place by tabs and slots, the panels of this invention could be affixed by other means, such as adhesive, staples, or other fasteners. Different configurations of the bottom panels to provide a substantially solid bottom without the need for gluing is also permissable. Furthermore, different means for retaining the string magazine portion 11 against the interior string end flap 18 in place of the integral bracing flaps 13 and 14 are possible. For example, the string magazine portion 11 may have projecting tabs on its left and right sides fitted to insert into slots cut in the first and second side panels 24 and 28. In addition, it should be understood that the score lines are primarily fold lines, and may be replaced with fold lines if desired.

It should be understood that this invention is not limited to the particular construction and arrangement of parts herein illustrated and described, but embodies all such modified forms as come within the scope of the following claims.

What is claimed is:

1. A kit for assembly into a device for bundling newspapers, comprising:

(a) a first paperboard blank having four rectangular side wall panels, the panels being adjacent one another and separated by fold lines, with an attachment panel extending from an edge of one of the side wall panels, and the first blank being bendable along the fold lines so that the attachment panel on the one panel may be connected to another side wall panel so that the four side wall panels may form a closed rectangular side wall assembly, and the first blank having a plurality of bottom panels depending from the side wall panels along a fold line and having engaging portions adapted to engage together in assembled relation to form a bottom for the closed rectangular side wall assembly;

(b) a second paperboard blank having a front panel with a bottom panel extending from the front panel along a fold line, and a top panel extending from the front panel adjacent a fold line opposite the bottom panel, such that the bottom and top panels may be folded along the fold lines and the folded second blank inserted within the side wall assembly of an assembled first blank with the front panel substantially parallel to and spaced from one side wall panel, the top panel positioned at an angle to the one side wall panel and spaced from the folded bottom panel of the second blank, and the one side wall panel of the first blank, and the top panel, front panel and bottom panel of the second blank will enclose and form a string compartment for containing a ball of string, the top panel having portions defining a hole for feeding a length of string from the string compartment, the front panel and three side wall panels of the assembled first and second blanks defining a paper compartment sized to receive folded newspapers in flat, stacked relation; and (c) string fastener means for engagement on the side wall panels in spaced relation to the bottom of an assembled first blank for retaining the length of string around stacked newspapers in the paper compartment prior to tying the stacked newspapers in a bundle.

2. The kit of claim 1 wherein a side wall panel of the first blank has portions defining an opening for receiving a ball of string and has a plurality of gripping fingers for retaining the ball of string substantially within the string compartment to permit a length of string to be removed from the gripped ball and fed through the hole in the second blank in a continuous manner.

3. The kit of claim 2 wherein the portions defining an opening form a gripping ring comprising a circular fold line, portions defining a cut-out opening centered within the circular fold line, and a plurality of cut-lines extending radially from the cut-out opening to the circular fold line, the circular fold line defining the opening for receiving the ball of string and the cut lines and the cut-out opening defining the gripping fingers which pivotally depend from the circular fold line to engage the ball of string and retain the ball within the opening.

4. The kit of claim 1 wherein the side wall panels have at least one score line in spaced relation to the fold line which lies along the bottom panels, the score line defining the top edge of the side wall panels, and wherein interior flaps extend from the side wall panels adjacent the score line, each flap being approximately the same size as the side wall panel from which it extends, wherein each flap has an outer edge with at least one locking tab extending therefrom, and wherein each bottom flap has at least one slot adjacent to the fold line along the bottom flap, so that each interior flap may be folded on the score line to lie adjacent to the side wall panels from which they extend to form a double side wall and the locking tabs will register in and engage the bottom wall slots to retain the interior flaps adjacent to the side wall panels.

5. The kit of claim 4 wherein the paperboard of the first blank is corrugated paperboard and wherein the side wall score line is a double score line to facilitate folding the interior flaps flat against the side wall panels.

6. The kit of claim 4 wherein two bracing flaps are formed by a cut line and a fold line in the interior flaps depending from two nonadjacent side wall panels, the bracing flaps being adapted to engage the front panel of the assembled second blank and hold the top panel and bottom panel of the second blank firmly against the interior flap depending from the side panel between the two nonadjacent side wall panels.

7. The kit of claim 1 wherein the top panel of the second paperboard blank extends from the front panel adjacent to a first front fold line and has an interior top panel extending outwardly from the top panel adjacent to at least one top fold line, the interior top panel being approximately the same size as the top panel from which it extends and the interior top panel has an outer edge with at least one locking tab extending therefrom, and wherein the front panel has at least one slot adjacent to the first front fold line from which extends the top panel, so that the interior top panel may be folded on the top fold line to lie adjacent to the top panel from which it extends to form a double wall and the locking tab will register in and engage the front panel slot to retain the interior top panel adjacent to the top panel.

8. The kit of claim 7 wherein the top panel of the second paperboard blank has portions defining a top string hole of sufficient dimensions to permit the threading and feeding of a length of string through the top string hole, and the top panel has portions defining a top slit radiating from the top string hole and wherein the interior top panel has portions defining an interior string hole of substantially the same dimensions as that of the top string hole; and the interior top panel has portions defining an interior slit radiating from the interior string hole of substantially the same length as the top slit; and wherein the portions defining the interior string hole and slit are positioned on the interior top panel so that when the interior top panel is folded on the top fold line to lie adjacent to the top panel, the top and interior string holes and slits are superposed, and the top and interior slits are adapted to fixedly engage the length of string issuing from the top and interior string holes.

9. The kit of claim 1 wherein the second paperboard blank bottom panel extends from the front panel adjacent to a second front fold line and has an interior bottom panel extending outwardly from the bottom panel adjacent to at least one bottom fold line, the interior bottom panel being approximately the same size as the bottom panel from which it extends and the interior bottom panel has an outer edge with at least one locking tab extending therefrom, and wherein the bottom panel has at least one slot adjacent to the second front fold line from which extends the bottom panel, so that the interior bottom panel may be folded on the bottom fold line to lie adjacent to the bottom panel from which it extends to form a double wall and the locking tab will register in and engage the bottom panel slot to retain the interior bottom panel adjacent to the bottom panel.

10. The kit of claim 1 wherein the top panel of the second paperboard blank has portions defining a top string hole of sufficient dimensions to permit the threading and feeding of a length of string through the top string hole, and the top panel has portions defining a top slit radiating from the top string hole, the top slit being adapted to fixedly engage the length of string issuing from the top string hole.

11. The kit of claim 1 wherein the string fastener means comprises portions located on the side walls of the first blank defining slits suitable for receiving string fasteners on the side wall panels in spaced relation to the bottom of the assembled first blank.

12. The kit of claim 1 wherein the attachment panel is attached to one of the side wall panels causing the side walls to form a closed rectangular side wall assembly; the bottom panels are engaged together to form a bottom for the closed rectangular side wall assembly; the second paperboard blank is folded along the fold lines to form an open-ended box and is inserted in the assembled first paperboard blank adjacent one side wall panel with the front panel substantially parallel to and spaced from the one side wall panel to form the string compartment adapted to containing a ball of string; and string fastener means are inserted in the side wall so as to retain a length of string for bundling of newspapers.

13. A device for bundling newspapers comprising:

(a) a first paperboard blank having a side wall comprising a string end panel, a back panel, two side panels and an attachment panel extending from an edge of one of the panels, the panels being defined in part by fold lines and the first blank being bendable along the fold lines so that the attachment panel on the one panel is connected to another panel and the side wall forms a closed rectangular side wall, and a plurality of bottom panels depend from the side wall panels along a fold line and engage together in assembled relation to form a bottom for the closed rectangular side wall, and the side wall has at least one score line in spaced relation to the fold line which lies along the bottom panels, the score line defining the top edge of the side wall panels, and interior flaps extend from the side wall panels adjacent the score line, each flap being approximately the same size as the side wall panel from which it extends, and each interior flap is folded on the score line to lie adjacent to the side wall panel from which it extends to form a double wall;

(b) a second paperboard blank having a front panel and a top panel, the panels being defined in part by fold lines and the second blank is folded along the fold lines and inserted within the rectangular side wall of the first blank adjacent the string end panel with the front panel substantially parallel to and spaced from the string end panel, the top panel positioned at an angle to the string end panel and spaced from the bottom of the second blank, and the string end panel, top panel, front panel and bottom panel define a string compartment for containing a ball of string, the top panel of the second blank having portions defining a hole for feeding a length of string from the string compartment, wherein the back panel of the first blank, the two side panels of the first blank, and the front panel of the second blank define a paper compartment sized to receive folded newspapers in flat, stacked relation;

(c) a plurality of gripping fingers for gripping a ball of string located on at least one of the string end panel and the interior string end panel of the first blank, the gripping fingers being disposed around an opening for retaining a ball of string substantially within the opening and the string compartment to permit a length of string to be removed from the gripped ball and to be fed through the hole in the second blank in a continuous manner; and (d) string fastener means engaged on the two side panels and the back panel of the side wall in spaced relation to the bottom for retaining the length of string around stacked newspapers in the paper compartment to facilitate tying the stacked newspapers in a bundle.

14. The device of claim 13 wherein the gripping fingers are arranged in a gripping ring, comprising a circular fold line, portions defining a cut-out opening centered within the circular fold line and a plurality of cut-lines extending radially from the cut-out opening to the circular fold line, the circular fold line defining the opening for receiving the ball of string and the cut lines and the cut-out opening defining the gripping fingers which pivotally depend from the circular fold line to engage the ball of string and retain the ball within the opening.

15. The device of claim 13 wherein the paperboard of the first blank is corrugated paperboard and wherein the score line is a double score line to facilitate folding the interior flaps against the side wall panels.

16. The device of claim 13 wherein the top panel of the second paperboard blank extends from the front panel adjacent to a first front fold line and has an interior top panel extending outwardly from the top panel adjacent to at least one top fold line, the interior top panel being approximately the same size as the top panel from which it extends and the interior top panel has an outer edge with at least one locking tab extending therefrom, and wherein the front panel has at least one slot adjacent to the first front fold line from which extends the top panel, and the interior top panel is folded on the top fold line to lie adjacent to the top panel from which it extends to form a double wall and the locking tab registers in and engages the front panel slot to retain the interior top panel adjacent to the top panel.

17. The device of claim 13 wherein the second paperboard blank has a bottom panel and the bottom panel extends from the front panel adjacent to a second front fold line and has an interior bottom panel extending outwardly from the bottom panel adjacent to at least one bottom fold line, the interior bottom panel being approximately the same size as the bottom panel from which it extends and the interior bottom panel has an outer edge with at least one locking tab extending therefrom, and wherein the bottom panel has at least one slot adjacent to the second front fold line from which extends the bottom panel, and the interior bottom panel is folded on the bottom fold line to lie adjacent to the bottom panel from which it extends to form a double wall and the locking tab registers in and engages the front panel slot to retain the interior bottom panel adjacent to the bottom panel.

18. The device of claim 13 wherein two bracing flaps extend inwardly from the interior flaps depending from the side walls in spaced relation to the string end panel, and the bracing flaps engage the front panel of the second blank and hold the top panel and bottom panel of the second blank firmly against the interior flap depending from the string end panel.

19. The device of claim 13 wherein the top panel of the second paperboard blank has portions defining a top string hole of sufficient dimensions to permit the threading and feeding of a length of string through the top string hole, and the top panel has portions defining a top slit radiating from the top string hole, the top slit being adapted to fixedly engage the length of string issuing from the top string hole.

20. The device of claim 13 wherein the top panel of the second paperboard blank has portions defining a top string hole of sufficient dimensions to permit the threading and feeding of a length of string through the top string hole, and the top panel has portions defining a top slit radiating from the top string hole and wherein the interior top panel has portions defining an interior string hole of substantially the same dimensions as that of the top string hole; and the interior top panel has portions defining an interior slit radiating from the interior string hole of substantially the same length as the top slit; and wherein the portions defining the interior string hole and slot are positioned on the interior top panel so that when the interior top panel is folded on the top fold line to lie adjacent to the top panel, the top and interior string holes and slits are superposed, and the top and interior slits are adapted to fixedly engage the length of string issuing from the top and interior string holes.

21. The device of claim 13 wherein the string fastener means are engaged by portions defining slits on the side wall panels in spaced relation to the bottom.

22. The device of claim 13 wherein the gripping fingers are located on both the string end panel and the interior string end panel in a position such that the gripping fingers on the interior panel will act in cooperation with the gripping fingers on the string end panel to grip a ball of string.

23. The device of claim 13 wherein each interior flap has an outer edge with at least one locking tab extending therefrom, each bottom panel has at least one slot adjacent to the fold line along the bottom panel, and wherein the locking tabs register in and engage the bottom panel slots to retain the interior flaps adjacent to the side wall panels.

24. A device for bundling newspapers, comprising:

(a) a first paperboard container with a vertical string end panel and three connected vertical side wall panels and interlocking flaps extending from the string end and connected side wall panels and engaged together to form a bottom for the first container;

(b) a second paperboard container with a front and four sides inserted within the first container such that the string end panel of the first container together with the second container forms a compartment for containing string, and the front of the second container together with the three connected side wall panels and the bottom of the first container form an open compartment for folded newspapers;

(c) fasteners protruding from the three connected side wall panels for the engagement of a length of string;

(d) string located within the string compartment and extending through a string hole formed by portions of the second container such that a length of string may be drawn from the string compartment and extended within the paper compartment and engage around the fastener prior to loading the device with newspapers to be bundled.

* * * * *